US006439101B1

(12) United States Patent
Kodama et al.

(10) Patent No.: US 6,439,101 B1
(45) Date of Patent: Aug. 27, 2002

(54) ELECTRO-HYDRAULIC SERVOMOTOR

(75) Inventors: Haruo Kodama; Nobuaki Shimizu; Youji Asano, all of Gifu (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/618,856

(22) Filed: Jul. 18, 2000

(30) Foreign Application Priority Data

Oct. 13, 1999 (JP) ..... 11-291477
Oct. 13, 1999 (JP) ..... 11-291478
Dec. 8, 1999 (JP) ..... 11-348927

(51) Int. Cl.[7] ..... F15B 9/10
(52) U.S. Cl. ..... 91/380; 74/416; 91/362
(58) Field of Search ..... 91/362, 363 R, 91/380, 180, 503; 476/24; 74/416, 412 R, 99 R, 89.16

(56) References Cited

U.S. PATENT DOCUMENTS 3,310,284 A * 3/1967 Inaba et al. ..... 91/380
3,530,764 A * 9/1970 Tomita ..... 91/380
4,793,561 A * 12/1988 Burda ..... 241/36
5,560,387 A * 10/1996 Devier et al. ..... 137/1

* cited by examiner

*Primary Examiner*—F. Daniel Lopez
*Assistant Examiner*—Thomas E. Lazo
(74) *Attorney, Agent, or Firm*—Akin, Gump, Strauss, Hauer & Feld, L.L.P.

(57) ABSTRACT

An electro-hydraulic servomotor includes: an electric motor (41) which rotates a drive shaft (51) in response to an inputted signal; a hydraulic motor (60) which rotates an output shaft (61) using hydraulic pressure of operation oil; a first geared shaft (53) rotatable along with the output shaft (61); a second geared shaft (52) threadingly engaged with the drive shaft (51) and meshed with the first geared shaft (53); and a spool (71) axially movable along with the second geared shaft (52) depending on a rotational difference between the drive shaft (51) and the first geared shaft (53), to control supply and discharge of the operation oil to and from the hydraulic motor. (60).

16 Claims, 13 Drawing Sheets

ELECTRO-HYDRAULIC SERVOMOTOR

BACKGROUND OF THE INVENTION

The present invention relates to an electro-hydraulic servomotor used for hydraulic shovels, cranes, asphalt finishers and machine tools (those machines will be referred to simply as external machines).

In this type of the electro-hydraulic servomotor, as shown in FIGS. 13 and 14, an output shaft 2 is rotatably supported on a casing 1 by bearings 3 and 4. A valve plate 9 is fastened to the inner wall of the casing 1, and a cylinder block 7 is fastened to the circumferential portion of the output shaft 2. A plurality of pressure chambers 7*a* is formed in the cylinder block 7. Pistons 8 are disposed within those pressure chambers 7*a*, and the pistons 8 are reciprocally moved in their axial direction by a hydraulic pressure of an operation oil introduced into the pistons 8.

A slanted plate, which is slanted at a given angle with respect to the valve plate 9, is fastened to a portion of the inner wall of the casing 1 which is closer to the top end of the output shaft 2. The top ends of the pistons 8 slidably push the slanted plate 6, and the cylinder block 7 slides to the valve plate 9, whereby the output shaft 2 and the cylinder block 7 are rotated together.

A spool valve 11, which moves in the axial direction, is provided in the casing 1. A screw member 12 and a gear 13 are fastened to the top end and the base end of the spool valve 11, respectively. A pulse motor 14 is mounted on the casing 1. A motor shaft 15 of he pulse motor 14 is rotatably supported on the casing 1. A rotational force of the motor shaft 15 is transmitted to the spool valve 11 via gears 16 and 13. A rotational force of the output shaft 2 is transmitted to the spool valve 11 via screw members 10 and 12. When the spool valve 11 is turned, an oil discharging passage 1, an oil supplying passage 1*b*, and communicating passages 1*d* and 1*d* communicate with one another. In the electro-hydraulic servomotor, the output shaft 2, the spool valve 11 and the pulse motor 14 are disposed on the same axial line.

Since in the thus constructed electro-hydraulic servomotor, the output shaft 2, spool valve 11 and the pulse motor 14 are disposed on the same axial line, the entire length of it is long. For this reason, it is difficult to neatly assemble the electro-hydraulic servomotor into another machine. A speed ratio of the screw members 10 and 12 is 1:1. Because of this, to increase the spindle speed of the output shaft 2, it is necessary to increase a capacity of the pulse motor 14 and to drive the pulse motor 14 at high speed. The spool valve 11 rotates together with the screw member 12. Therefore, a sliding surface of the casing 1, which is in contact with the spool valve 11, will be worn because of presence of its friction resistance.

SUMMARY OF THE INVENTION

Accordingly, an object of the present invention is to provide an electro-hydraulic servomotor which is small in size.

Another object of the present invention is to provide an electro-hydraulic servomotor which enables the capacity of it to be reduced, and is free from wearing of the spool valve and the casing.

Another object of the invention is to provide a small electro-hydraulic servomotor which reliably controls a spool position of the spool in the axial line direction independently of temperature of the operation oil.

As a preferred embodiment of the present invention, an electro-hydraulic servomotor is provided, which includes:

an electric motor which rotates a drive shaft in response to an inputted signal; a hydraulic motor which rotates an output shaft using hydraulic pressure of operation oil; a first geared shaft rotatable along with the output shaft; a second geared shaft threadingly engaged with the drive shaft and meshed with the first geared shaft; a spool axially movable along with the second geared shaft depending on a rotational difference between the drive shaft and the first geared shaft to control supply and discharge of the operation oil to and from the hydraulic motor. According to the servomotor can be made small in size.

In the electro-hydraulic servomotor, the spool may be constructed as a single integral member, maybe divided into first and second discrete spool members. The first and second spool members are preferably urged toward one another.

The electro-hydraulic servomotor may further include: a displacement sensor which detects an axial position of the spool.

The electro-hydraulic servomotor may further include: a rotary sensor which detects number of rotation of the first geared shaft.

The present disclosure relates to the subject matter contained in Japanese patent application Nos. Hei. 11-13633 (filed on Jan. 21, 1999), Hei. 11-291477 (filed on Oct. 13, 1999), Hei. 11-291478 (filed on Oct. 13, 1999) and Hei. 11-348927 (filed on Dec. 8, 1999), which are expressly incorporated herein by reference in their entireties.

DESCRIPTION OF THE PREFERRED EMBODIMENT

Figure 1:
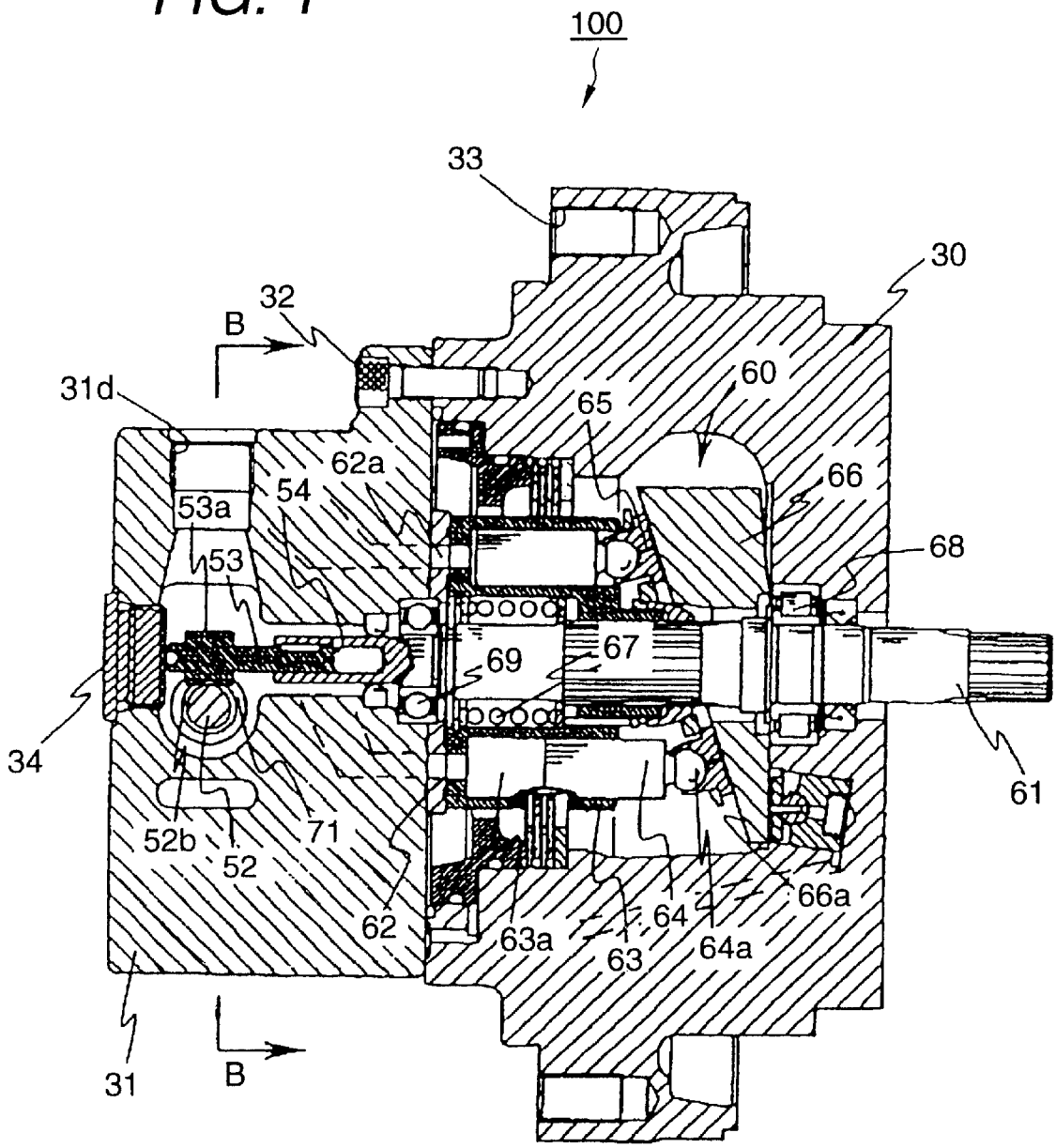
FIG. 1 is a sectional side view showing an electro-hydraulic servomotor according to a first embodiment of the present invention.
Figure 2:
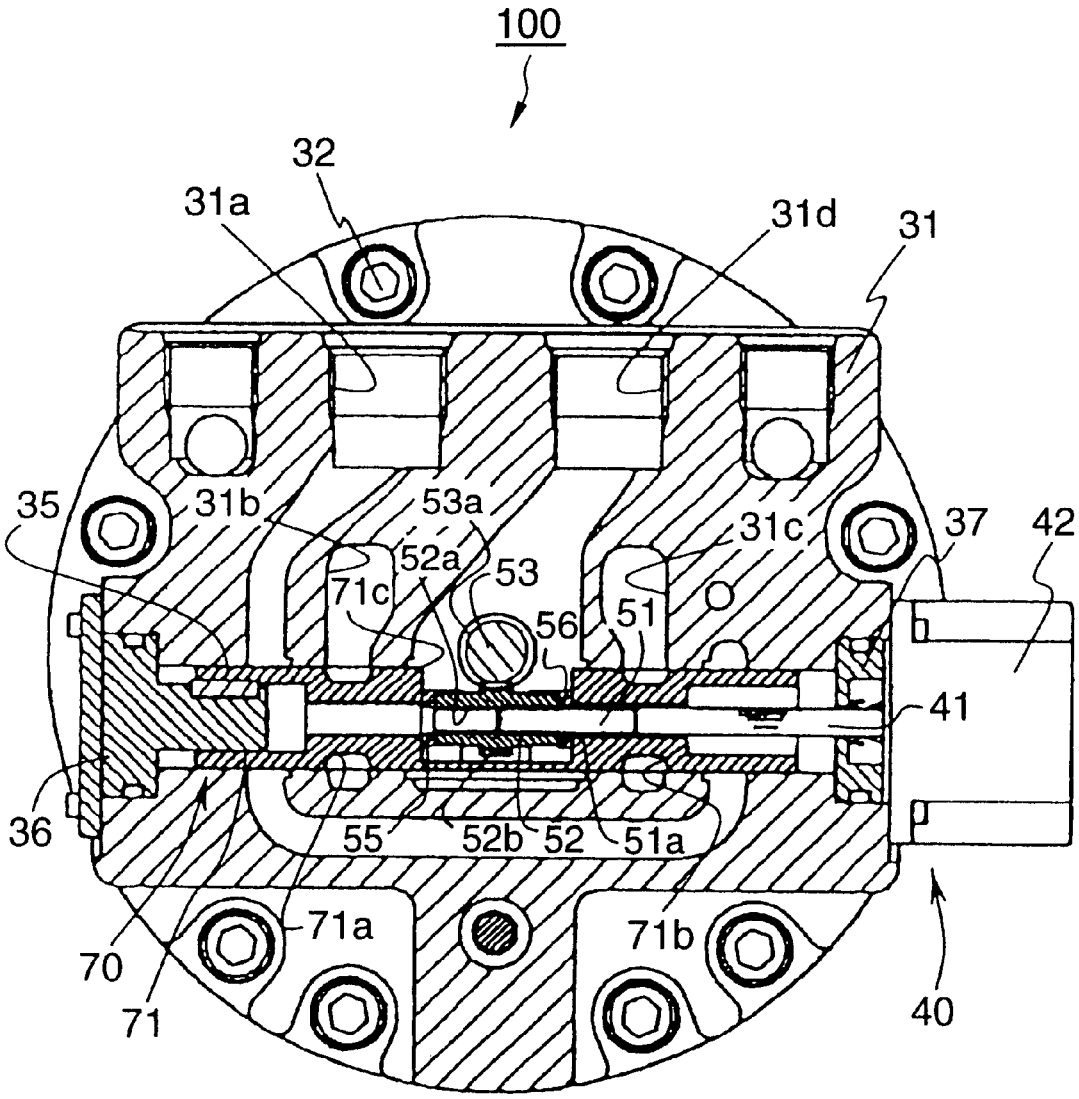
FIG. 2 is a sectional view taken along a line B—B of FIG. 1.
Figure 3:
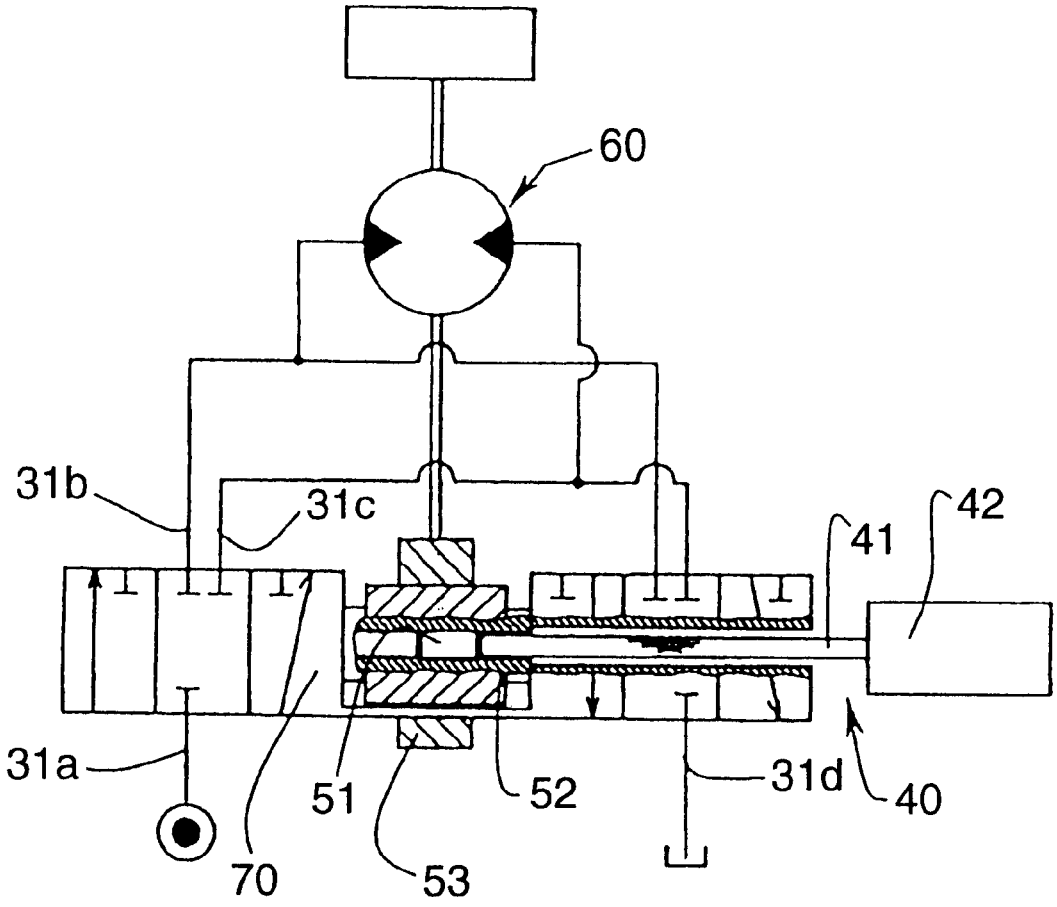
FIG. 3 is a schematic view showing an arrangement of the electro-hydraulic servomotor shown in FIG. 1.
Figure 4:
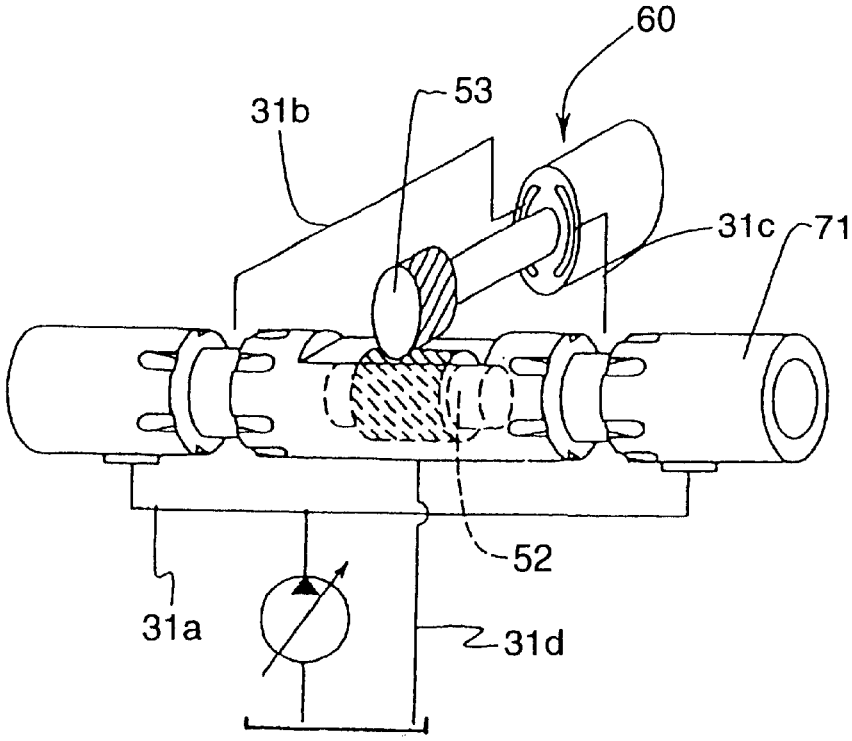
FIG. 4 is a perspective view showing major parts of the electro-hydraulic-servomotor shown in FIG. 1.
Figure 5:
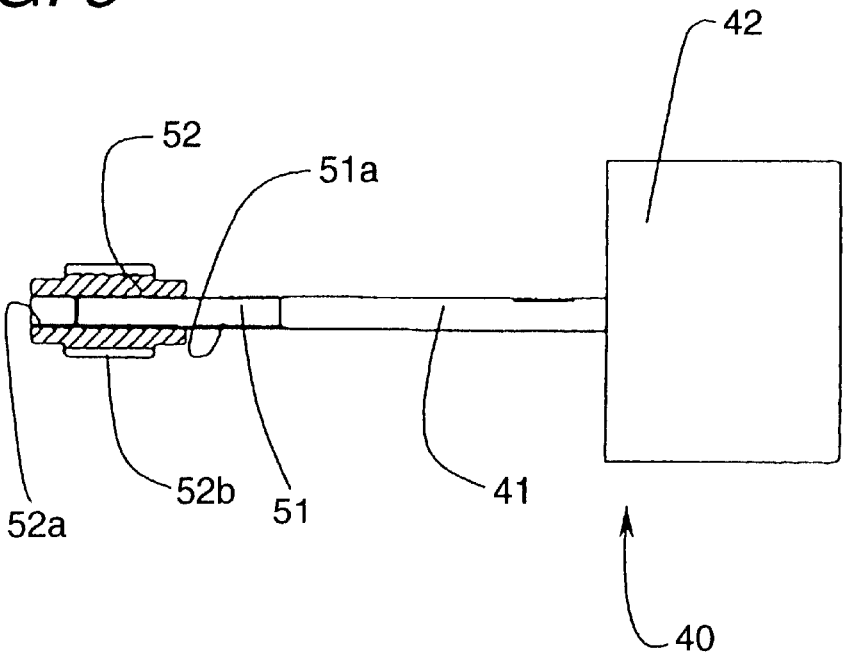
FIG. 5 is a front view showing an electric motor and the vicinities thereof in the electro-hydraulic motor shown in FIG. 1 .

The preferred embodiments of the present invention will be described with reference to the accompanying drawings.

<1st Embodiment>

A construction of an electro-hydraulic servomotor according to an embodiment of the present invention will be described.

In FIGS. 1 through 4, an electro-hydraulic servomotor 100 includes a first casing 30 shaped like a cup, and a second casing 31 fastened to the first casing 30 by a bolt 32. The first casing 30 includes a bolt hole 33 bored therein into which a bolt is screwed when the electro-hydraulic servomotor 100 is firmly fixed to an external machine, not shown. An oil supplying passage 31*a,* communicating passages 31*b* and 31*c,* and an oil discharging passage 31*d* are formed in the second casing 31.

A pulse motor 40 as an electric motor for rotating a rotary shaft 41 in accordance with a signal input thereto is mounted on the outer wall of the second casing 31. A drive shaft 51, as a first shaft, having a male screw 51*a* formed in the outer circumferential surface is integrally coupled to the rotary shaft 41 of the pulse motor 40 such that those shafts will rotate in the same directions. In the embodiment, the rotary shaft 41 and the drive shaft 51 are formed in a one-piece construction. If required, those drive shafts 41 and 51 may separately be formed. Reference numeral 37 designates a cap cover for preventing the operation oil from flowing into a pulse motor body 42.

A first helical gear 52, as a second shaft, is cylindrical in shape, and includes a female screw 52*a* formed on the inner circumferential surface thereof and an external gear 52*b* formed on the outer circumferential surface thereof. The first helical gear 52 is coupled to the drive shaft 51 such that the male screw 51*a* of the drive shaft 51 is screwed into the female screw 52*a* of the first helical gear 52. A second helical gear 53, as a third shaft, which includes an external gear 53*a* formed on the outer circumferential surface thereof, is coupled to the first helical gear 52 such that the external gear 52*b* of the first helical gear 52 intermeshes with the external gear 53*a* of the second helical gear 53, while those helical gears 52 and 53 are oriented such that the axial lines of those helical gears are perpendicular to each other.

One end of a hydraulic pressure motor 60 as hydraulic pressure driving means to be described later is integrally coupled to one end of the second helical gear 53 with the aid of a coupling member 54 such that the motor and the gear rotate in the same directions. The other end of the second helical gear 53 is rotatably supported on a cap cover 34 applied to the second casing 31. In the embodiment, the second helical gear 53 and an output shaft 61 are separately formed. If necessary, those component parts 53 and 61 may be formed in one-piece construction.

The male screw 51*a,* female screw 52*a,* external gear 52*b* and external gear 53*a* are configured such that when the number of revolutions of the drive shaft 51 is different from that of the second helical gear 53, the first helical gear 52 moves in the axial line direction while rotating about its axis in accordance with the number-of-revolutions difference.

The hydraulic pressure motor 60 is rotatably supported on the first and second casings 30 and 31 with the aid of gears 68 and 69. The hydraulic pressure motor 60 is made up of the output shaft 61, a valve plate 62, a cylinder block 63, pistons 64, shoe members 65, and a slanted plate 66. The output shaft 61 is urged toward the other end thereof by an urging force of a spring 67. The valve plate 62, fastened to the side wall of the second casing 31, includes a plurality of arcuate holes 62*a*. Those holes are arranged equidistantly in the circumferential direction on the valve plate, and communicate with the communicating passage 31*b* and the communicating passage 31*c*. The cylinder block 63 is brought into slidable contact with the valve plate 62 by an urging force of the 67. The cylinder block 63 is fixed to the outer circumference of the output shaft 61 such that the block and the shaft rotate in the same directions. The cylinder block 63 includes a plurality of pressure chambers 63*a*. Those pressure chambers 63*a* are arranged equidistantly arranged on the cylinder block in a state that their axial lines are parallel to the axial line of the output shaft 61. A plurality of pistons 64 include spherical ends 64*a* formed at the top ends, respectively. And those are located within the pressure chambers 63*a* of the cylinder block 63 such that those are slidable in the axial line directions. The shoe members 65 engage the spherical ends 64*a* of the pistons 64 while rollable thereon. The slanted plate 66 is secured to the inner wall of the first casing 30. It slidably engages the shoe members 65. It includes a slanted surface 66*a* slanted at a given angle with respect to the output shaft 61.

The output shaft 61 protruded out of the first casing 30 is coupled to a drive section of the external machine (not shown) so that its rotational force is transmitted to the drive section.

A spool valve 70 is formed with a spool 71 and the second casing 31.

A spool 71 is coupled to the first helical gear 52 through gears 55 and 56 as a pair of gear means. The spool 71 slidably engages a cap cover 36 mounted on the second casing 31, while a key 35 as spool-rotation preventing means interposed therebetween. Therefore, the spool 71 does not rotate about its axis.

The gears 55 and 56 consist of thrust bushes, respectively.

An elongated groove 71*c,* while extending in the axial line direction, is formed in the mid portion of the spool 71 as viewed in the axial line direction. The first helical gear 52 is inserted into the elongated groove 71*c,* and held by the spool 71 such that the axial line of the spool 71 is parallel to that of the first helical gear 52. The spool 71 slidably engages the cap cover 36, which is mounted on the second casing 31 with the aid of the key 35. With this structure, the spool 71 does not turn about its axis.

Annular grooves 71*a* and 71*b* are formed in the outer circumferential surface of the spool 71. Those grooves allow the oil supplying passage 31*a* and the oil discharging passage 31*d* of the second casing 31 to communicate with the communicating passage 31*b* or 31*c*.

An operation of the thus constructed electro-hydraulic servomotor 100 will be described.

When the number of revolutions of the rotary shaft 41 is different from that of the output shaft 61, the electro-hydraulic servomotor 100 rotates the output shaft 61 in accordance with a number-of-revolutions difference between those shafts 41 and 61.

An operation description will be given hereunder about a case where when the number of revolutions of the rotary shaft 41 is different from that of the output shaft 61, the electro-hydraulic servomotor 100 rotates the output shaft 61 in accordance with the number-of-revolutions difference between those shafts 41 and 61.

Since the drive shaft 51 is integrally coupled to the rotary shaft 41 such that those shafts rotate in the same directions, the number of revolutions of the rotary shaft 41 is equal to that of the drive shaft 51. Since the second helical gear 53 is integrally coupled to the output shaft 61 through the coupling member 54 such that those components rotate in the same direction, the number of revolutions of the output shaft 61 is equal to that of the second helical gear 53.

Therefore, when a difference is produced between the numbers of revolutions of the rotary shaft 41 and the output shaft 61, a difference is produced also between the numbers of revolutions of the drive shaft 51 and the second helical gear 53.

When the number of revolutions of the drive shaft 51 is different from that of the second helical gear 53, the first helical gear 52 moves in the axial direction while rotating about its axis in accordance with the difference of the number of revolutions between the drive shaft 51 and the second helical gear 53, as described above.

When the first helical gear 52 moves in the axial direction while rotating about its axis, the spool 71 is coupled to the first helical gear 52 through the gears 55 and 56, and the spool 71 also moves in the axial line direction while linking with a motion of the first helical gear 52. When the spool 71 moves in the axial direction with the motion of the first helical gear 52, the operation oil flowing through the oil supplying passage 31*a,* communicating passage 31*b,* communicating passage 31*c* and oil discharging passage 31*d* varies in its flow rate since the annular grooves 71*a* and 71*b,* which communicate the oil supplying passage 31*a* of the second casing 31 with the communicating passage 31*b* or 31*c* thereof, are formed in the outer circumferential surface of the spool 71.

When the operation oil flowing through the oil supplying passage 31*a,* communicating passage 31*b,* communicating passage 31*c* and oil discharging passage 31*d* varies in its flow rate, a flow rate of the operation oil flowing out into the plurality of the pressure chambers 63*a* since the communicating passages 31*b* and 31*c* communicate with the plurality of the pressure chambers 63*a,* which are formed in the cylinder block 63, via the plurality of the arcuate holes 62*a* formed in the valve plate 62. When the operation oil flowing out to the plurality of the pressure chambers 63*a* varies in its flow rate, The pistons 64 slides in the axial direction in accordance with a pressure of the operation oil flowing out into the plurality of the pressure chambers 63*a* since the pistons 64 are slidably located within the pressure chambers 63*a* of the cylinder block 63. When the pistons 64 slide in the axial direction, the pistons 64 press the slanted surface 66*a* of the slanted plate 66 with the aid of the shoe members 65 since the spherical ends 64*a* of the pistons 64 engage the shoe members 65 in a rollable fashion, and the shoe members 65 slidably engage the slanted surface 66*a* of the slanted plate 66. When the pistons 64 press the slanted surface 66*a* of the slanted plate 66 through the shoe members 65, the cylinder block 63 is rotated about its axis by a counter force to the force by the pistons 64 which presses the slanted surface 66*a* of the slanted plate 66.

When the cylinder block 63 rotates about its axis, the pressure chambers 63*a,* which are formed in the cylinder block 63 and communicate with the communicating passages 31*b* and 31*c* through the plurality of the arcuate holes 62*a* formed in the valve plate 62, vary in pressure. When the pressure chambers 63*a,* which are formed in the cylinder block 63 and communicate with the communicating passages 31*b* and 31*c* through the plurality of the arcuate holes 62*a* formed in the valve plate 62, vary in pressure, a flow rate of the operation oil flowing into the plurality of the pressure chambers 63*a* varies. When a flow rate of the operation oil flowing into the plurality of the pressure chambers 63*a* varies, the cylinder block 63 rotates again about its axis, as described above.

Accordingly, when the operation oil flowing through the oil supplying passage 31*a,* communicating passages 31*b* and 31*c* and oil discharging passage 31*d* varies in flow rate, the cylinder block 63 rotates about its axis in a rotational direction and at a spindle speed, which depend on a flow rate of the operation oil flowing through the oil supplying passage 31*a,* communicating passages 31*b* and 31*c* and oil discharging passage 31*d.*

When the cylinder block 63 rotates about its axis in a rotational direction and at a spindle speed, which depend on a flow rate of the operation oil flowing through the oil supplying passage 31*a,* communicating passages 31*b* and 31*c* and oil discharging passage 31*d,* the output shaft 61 also rotates about its axis in a rotational direction and at a spindle speed, which depend on a flow rate of the operation oil flowing through the oil supplying passage 31*a,* communicating passages 31*b* and 31*c* and oil discharging passage 31*d* since the cylinder block 63 is fastened to the peripheral outer surface of the output shaft 61 such that the block and the shaft rotate in the same rotational directions.

A direction in which the first helical gear 52 axially moves while rotating about its axis when a difference of the number of revolutions between the drive shaft 51 and the second helical gear 53 is produced, may be determined by the configurations of the male screw 51*a,* female screw 52*a,* external gear 53*a* and external gear 52*b.* That is, when a difference of the number of revolutions is produced between the drive shaft 51 and the second helical gear 53 by the configurations of the male screw 51*a*, female screw 52*a,* and external gears 53*a* and 52*b,* the rotational direction and the spindle speed in and at which the output shaft 61 rotates may be determined depending on the number-of-revolutions difference between the drive shaft 51 and the second helical gear 53.

Accordingly, when the configurations of the male screw 51*a*, female screw 52*a,* and external gears 53*a* and 52*b* are determined and as a result, a number-of-revolutions difference is produced between the drive shaft 51 and the second helical gear 53, that is, a number-of-revolutions difference is produced between the rotary shaft 41 and the output shaft 61, the output shaft 61 may be rotated so as to reduce the number-of-revolutions difference that is produced between the rotary shaft 41 and the output shaft 61.

Thus, when the number-of-revolutions difference is produced between the rotary shaft 41 and the output shaft 61, the electro-hydraulic servomotor 100 rotates the output shaft 61 in accordance with the number-of-revolutions difference between the rotary shaft 41 and the output shaft 61.

The key 35 prevents the spool 71 from turning about its axis. Accordingly, it prevents such an unwanted situation that the spool 71 turns about its axis and collides with the second helical gear 53, thereby damaging the spool 71 or the second helical gear 53.

While in the embodiment described above, the second and third shafts are the helical gears, it is evident that those may be constructed with other suitable components than the helical gears. A given velocity ratio may be set up between the second and third shafts by use of another transmission gear, worm gear and worm wheel or the like. When the given velocity ratio may be set up between the second and third shafts, the number of revolutions of the output shaft 61 is reduced by the second and third shafts. Accordingly, the number of revolutions of the second shaft may be smaller than that of the output shaft 61. As a result, the pulse motor 40 may be reduced in capacity, and hence the electro-hydraulic servomotor 100 is reduced in size.

In the embodiment, the gears 55 and 56 are constructed with thrust bushes. It is evident that any other components than the thrust bushes may be used if the following requirement is satisfied: when the first helical gear 52 moves in the axial line direction, the spool 71 is moved in the axial line direction, and when the first helical gear 52 rotates about its axis, the spool 71 is prevented from being turned about its axis.

In the embodiment, the first helical gear 52 is coupled to the second helical gear 53 such that the axial lines of those gears are perpendicular to each other. Accordingly, the axial line of the rotary shaft 41 is perpendicular to that of the output shaft 61. If required, the rotary shaft 41 and the output shaft 61 may be arranged so that the prolongation of the axial line of the rotary shaft 41 is oriented at another angle with respect to the prolongation of the axial line of the output shaft 61.

In the embodiment, the spool 71 is coupled to the first helical gear 52 through the gears 55 and 56. If necessary, the spool 71 may be coupled to the first helical gear 52 through a spring.

<2nd Embodiment>

Figure 6:
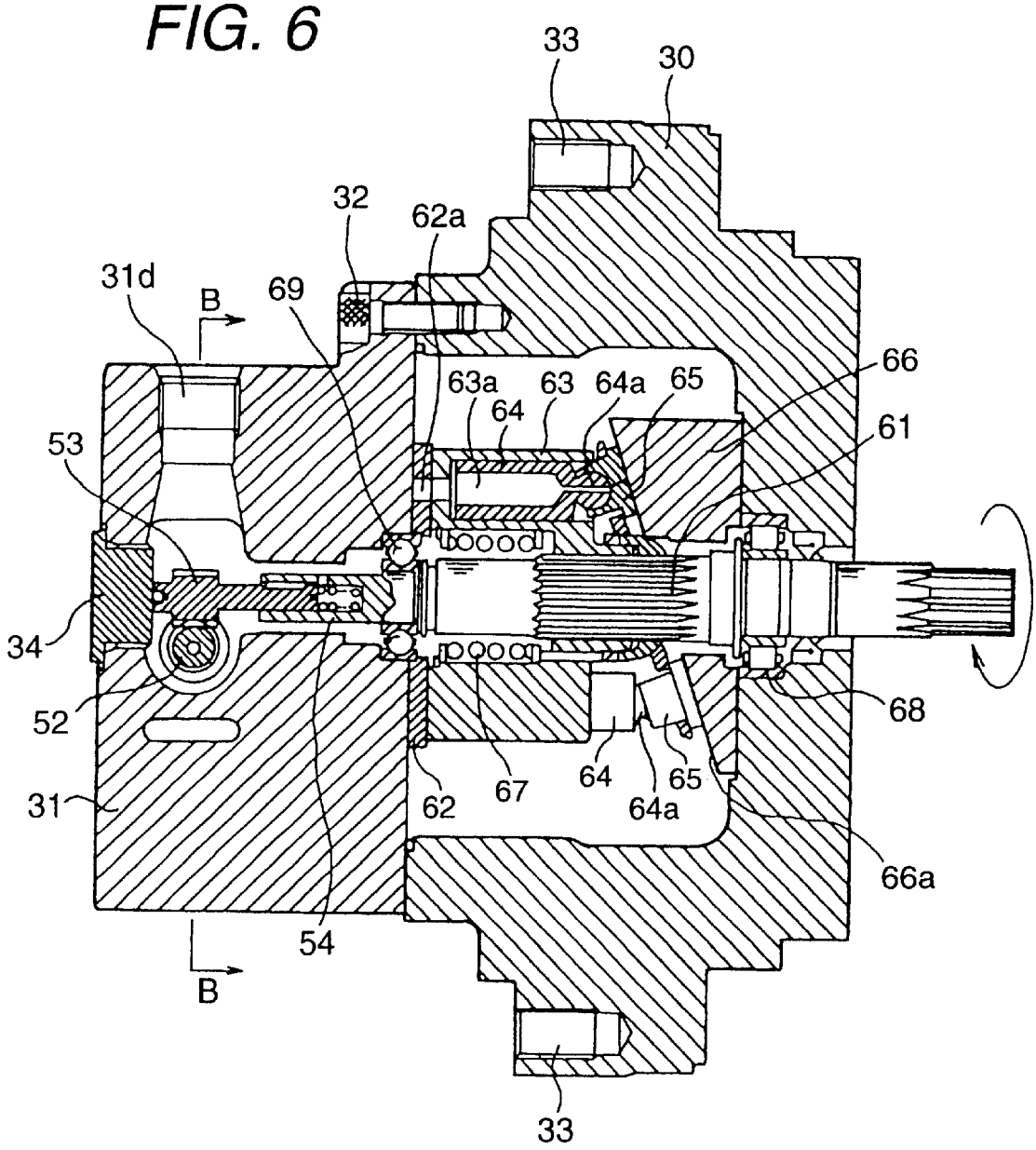
FIG. 6 is a sectional view showing an electro-hydraulic servomotor according to a second embodiment of the present invention.
Figure 7:
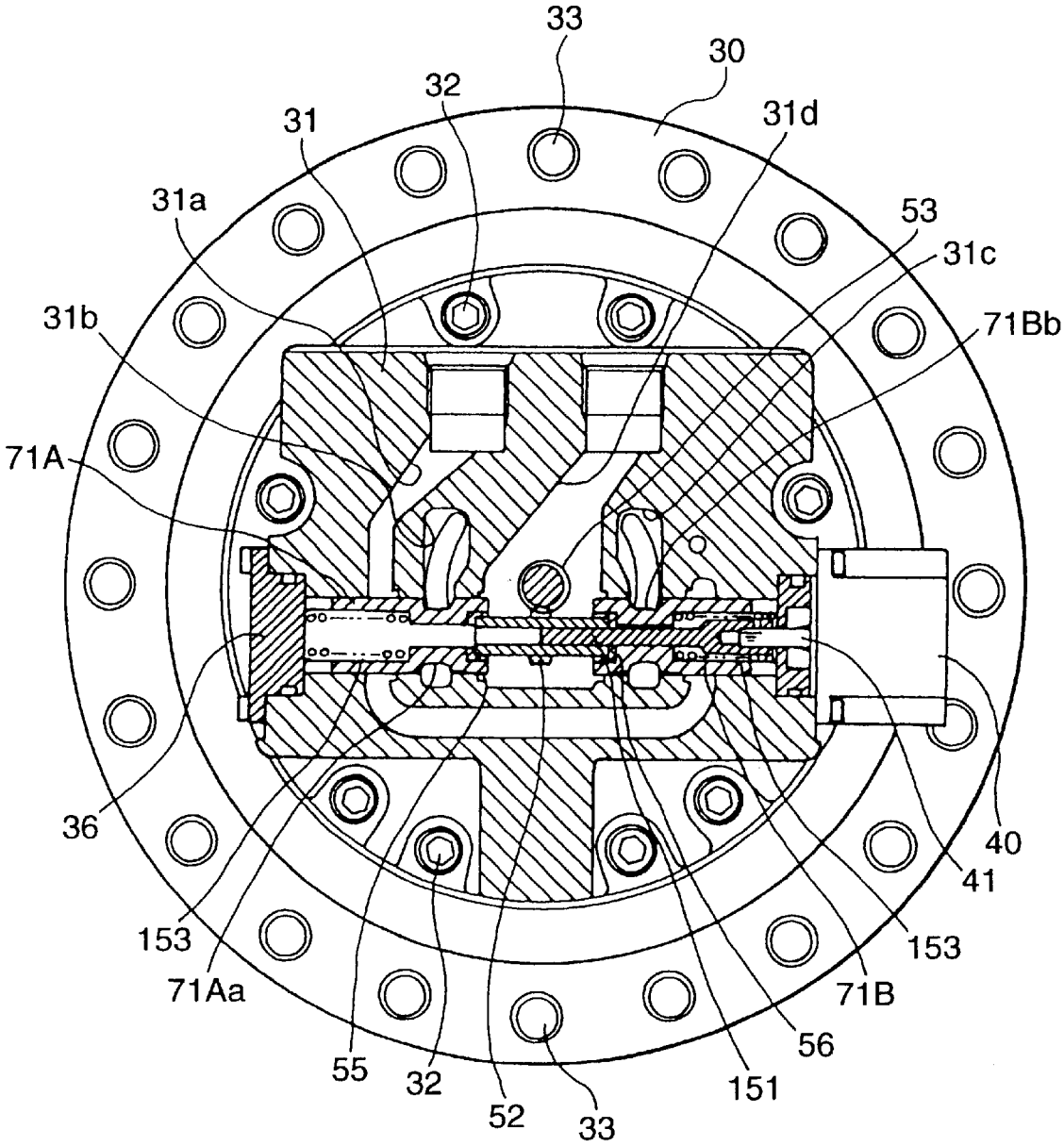
FIG. 7 is a sectional view taken along a line B—B of FIG. 6.

A second embodiment of the present invention will be described with reference to FIGS. 6 and 7. One of the features of the second embodiment resides in that the spool 71 in the first embodiment is divided into a couple of spools 71A and 71B.

A couple of spools 71A and 71B, respectively, are rotatably coupled to both ends of a helical gear 52, while bearing 55 and 56 are interposed therebetween, respectively. The spools 71A and 71B are respectively urged by a couple of springs 153 so that those spools approach to each other. A backlash of a screw drive portion of the helical gear 52, which will be caused by the drive shaft 151, may be removed in a manner that the spring loads of the springs 153 are selected to have a proper difference therebetween.

The annular grooves 71A*a* and 71B*b*, while extending in the circumferential directions, are formed in the outer surfaces of the annular grooves 71A*a* and 71B*b*, respectively. When those spools are moved in the axial directions, the annular grooves 71A*a* and 71B*b* communicate with an oil discharging passage 31*d*, an oil supplying passage 31*a* and communicating passages 31*b* and 31*c*, which are formed in a second casing 31, whereby the annular grooves 71A*a* and 71B*b* are controlled in their opening percentage. To be more specific, in FIG. 7, when the helical gear 52 is moved to the right, the oil discharging passage 31*d* communicates with the communicating passage 31*b*, and the communicating passage 31*c* communicates with the oil supplying passage 31*a*, and an operation oil is supplied to and discharged from an arcuate hole 62*a* of a valve plate 62. When the helical gear 52 is moved to the left, the oil supplying passage 31*a* communicates with the communicating passage 31*b*, and the communicating passage 31*c* communicates with the oil discharging passage 31*d*, and the operation oil is supplied to and discharged from the arcuate hole 62*a* of the valve plate 62.

An electric motor, e.g., a pulse motor 40, is mounted on an outer wall of the second casing 31. A drive shaft 151 is coupled to the motor shaft 41 of the pulse motor 40. The drive shaft 151 is inserted into the helical gear 52, and coupled to the same by means of screws. The pulse motor 40 is movable in either of the axial directions with rotation of the motor shaft 41 of the pulse motor 40.

An operation of the invention will be described.

In the electro-hydraulic servomotor described above, when the drive shaft 151 is rotated, the helical gear 52 is moved to either of the axial directions, and the number of revolutions of the output shaft 61 is controlled following up the number of revolutions of the pulse motor 40. The operation oil is supplied to the pressure chamber 63*a* of the cylinder block, and a counter force, which is generated when a top end 64*a* of a piston 64 presses a slanted plate 66, causes the output shaft 61 to rotate together with the cylinder block 63, whereby an external machine is driven. Selection of the supplying or discharging of the operation oil to and from the pressure chamber 63*a* is carried out by the cylinder block 63 and the arcuate hole 62*a* of the valve plate 62.

When a load acts on the external machine by some reason, and the number of revolutions of the output shaft 61 decreases, the number of revolutions of the helical gear 53 decreases, so that a difference is produced between the number of revolutions of the helical gear 53 and that of the drive shaft 151. The helical gear 52 helically moves with respect to the drive shaft 151, and moves in its direction.

With the movement of the helical gear 52, the couple of the spools 71A and 71B move in their axial direction, and the annular grooves 71A*a* and 71B*b* are increased in their opening percentage. For this reason, the operation oil that is introduced through the oil supplying passage 31*a* is supplied to one of the arcuate holes 62*a* and the pressure chamber 63*a* of the piston 64, through the annular groove 71A*a* of the spool 71A of those spools and the communicating passage 31*b*. In this case, an amount of the operation oil supplied to the arcuate holes 62*a* is larger than that of the operation oil supplied to the pressure chamber 63*a*. Accordingly, the piston 64 strongly presses the slanted plate 66, and at the same time the operation oil in the compressed side pressure chamber 63*a* of the piston 64 is discharged in large amount through the oil discharging passage 31*d* from the other arcuate holes 62*a* of the valve plate 62, via the communicating passage 31*c* and the annular groove 71B*b* of the other spool 71B. As a result, the number of revolutions of the output shaft 61 increases.

In this way, with the movement of the spools 71A and 71B, the number of revolutions of the output shaft 61 is increased up to a predetermined number of revolutions, and the former is fairly accurately controlled so as to follow up the number of revolutions of the pulse motor 40.

<3rd Embodiment>

Figure 8:
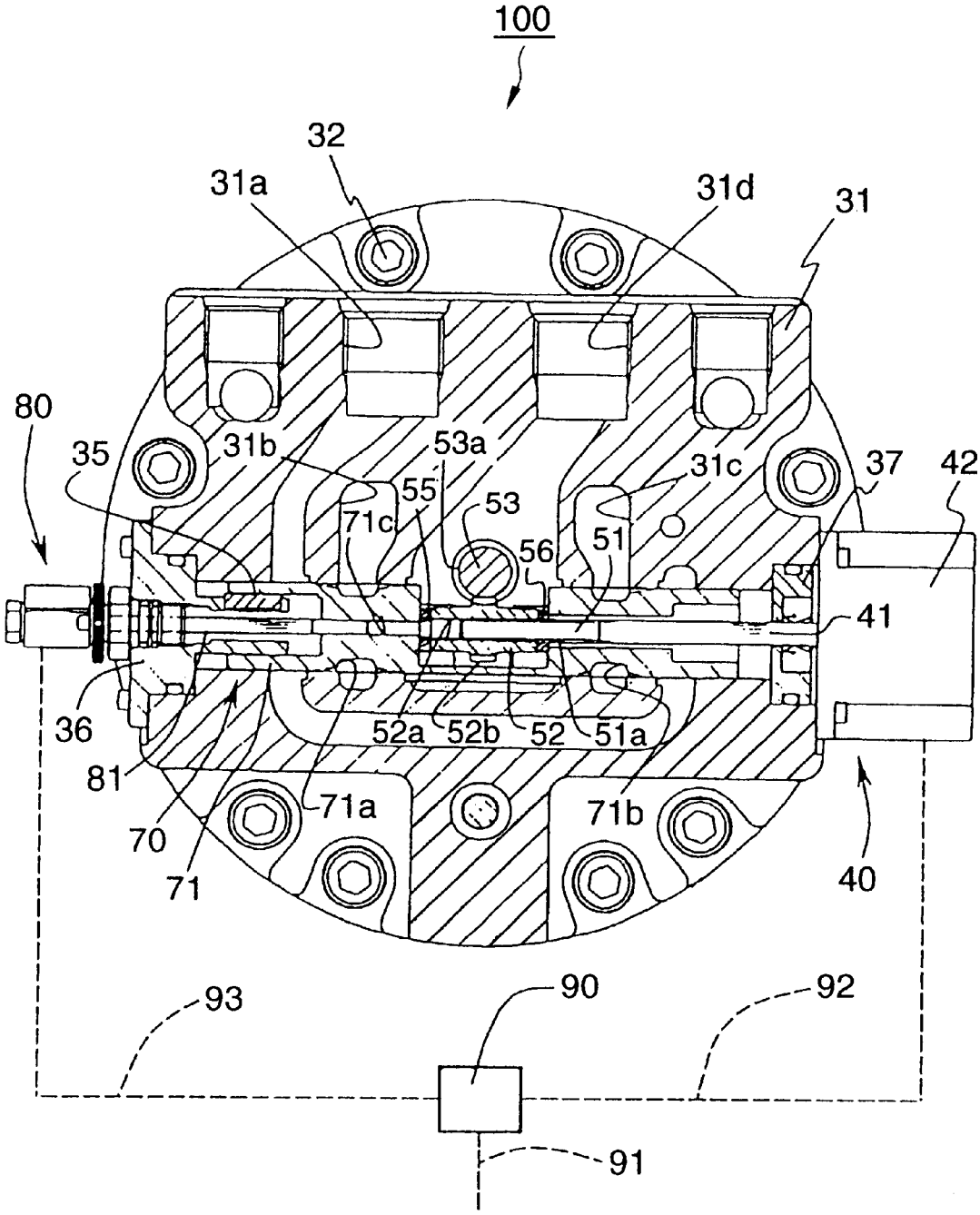
FIG. 8 is a sectional view showing an electro-hydraulic servomotor according to a third embodiment of the present invention, which is taken along a line corresponding to the line B—B of FIG. 1 or 6.
Figure 9:
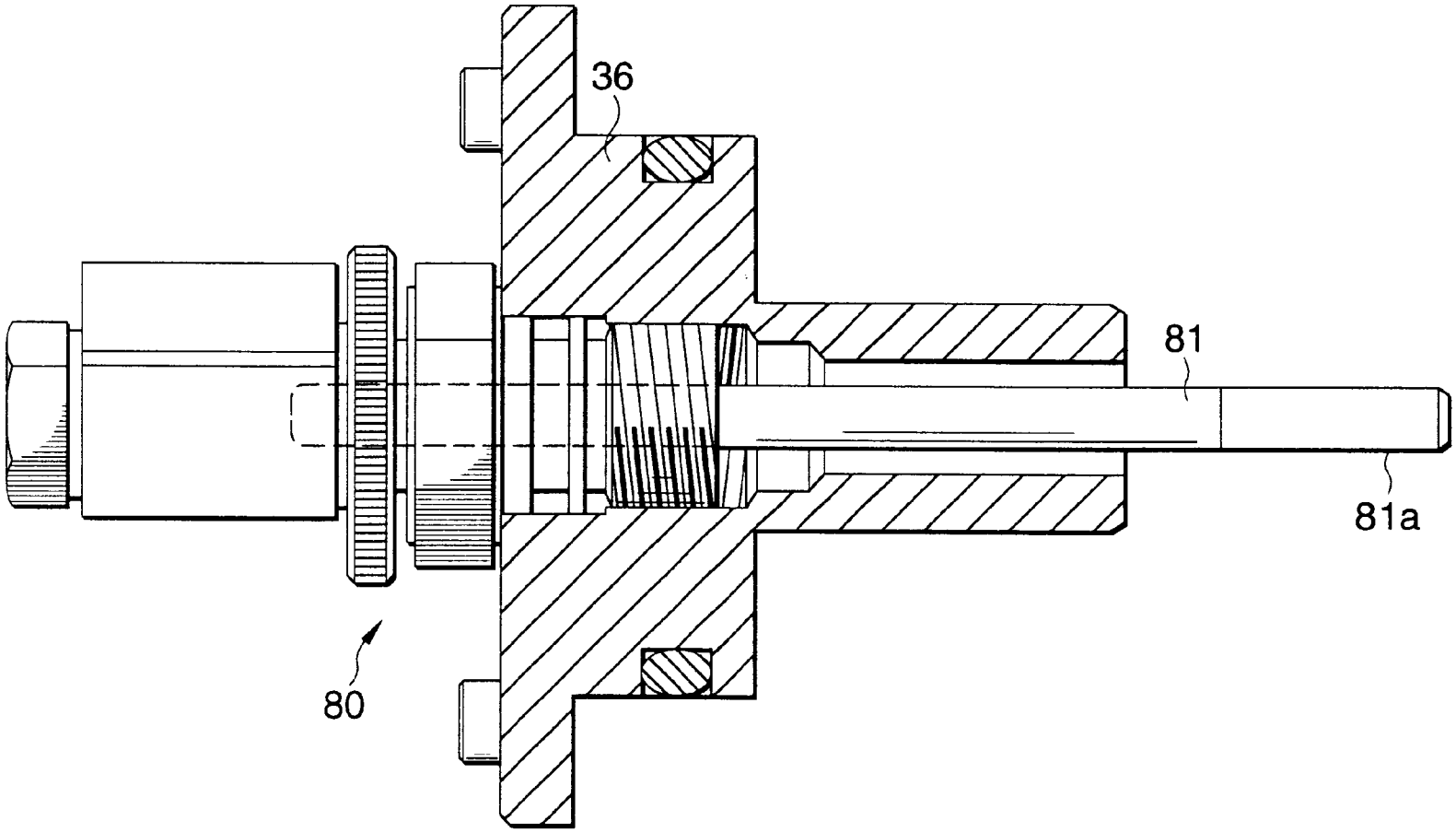
FIG. 9 is a sectional side view showing spool position detecting means and vicinities thereof shown in FIG. 8.
Figure 10:
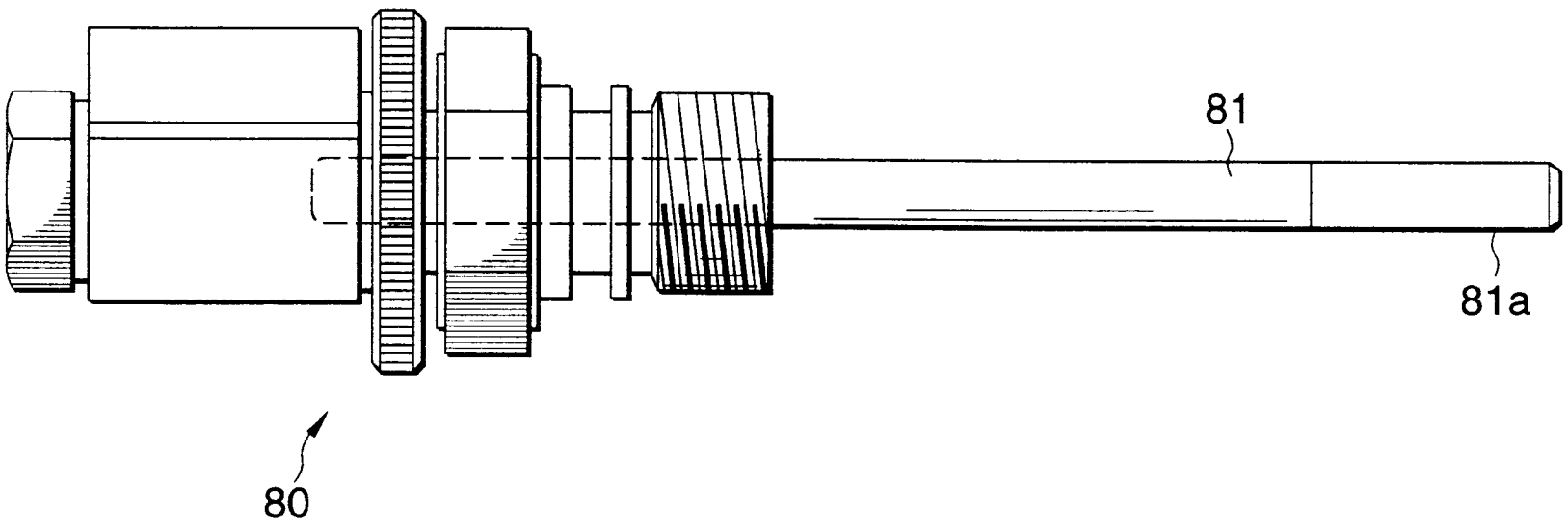
FIG. 10 is a side view showing the spool position detecting means.

One of the features of a third embodiment shown in FIGS. 8 through 10 resides in that a displacement sensor 80 is added to the mechanical arrangement of the first embodiment.

Reference numeral 80 designates a displacement sensor 80 as signal detecting means which detects a position of the spool 71 as viewed in the axial line direction, and outputs a spool signal in accordance with the spool position. The displacement sensor 80 includes a sensor shaft 81 and is fixed to the cap cover 36. A male screw is formed at the top end 81*a* of the sensor shaft 81. A female screw is formed in the sensor shaft coupling portion 71*c* of the spool 71. Therefore, the sensor shaft 81 is coupled to the spool 71 by screwing the male screw of the top end 81*a* into the female screw of the sensor shaft coupling portion 71*c*.

Reference numeral 90 designates a central processing unit (referred simply to as CPU) as input signal processing means which processes a signal to be input to the pulse motor 40 and a spool position signal so that a position of the spool 71 as viewed in the axial line direction is within a predetermined range, and outputs the resultant signal to the pulse motor 40.

Reference numerals 91, 92 and 93 are signal transmission paths, respectively.

The pulse motor 40 is located at one end of the spool 71, and the displacement sensor 80 is located at the other end of the spool 71.

The electro-hydraulic servomotor 100 is capable of preventing the spool 71 from colliding with the cap cover 36 or the cap cover 37 by use of the displacement sensor 80.

An operation of the displacement sensor 80 will be described.

As described above, the sensor shaft 81 is coupled to the spool 71, so that when the spool 71 moves in the axial line direction, the sensor shaft 81 also moves in the axial line direction. Accordingly, the displacement sensor 80 detects a spool position of the spool valve 70 in the axial line direction by detecting a distance of the sensor shaft 81 measured from its initial position.

The displacement sensor 80 outputs a spool position signal which depends on the detected spool position of the spool valve 70 in the axial line direction.

Next, the function of the electro-hydraulic servomotor 100 which prevents the spool 71 from colliding with the cap cover 36 or 37 by use of the displacement sensor 80 will be described.

For some reason, for example, the reason that a great difference of the number of revolutions occurs between the rotary shaft 41 and the output shaft 61, the spool 71 greatly moves in the axial line direction while linking with a motion of the first helical gear 52, and approaches a position located within a predetermined distance from the cap cover 36 or cap cover 37.

Then, the spool 71 approaches a position within a predetermined distance from the cap cover 36 or 37, and then the CPU 90 judges that the spool 71 has approached a position within the predetermined distance from the cap cover 36 or 37, from a spool signal output through the signal transmission path 93 from the displacement sensor 80.

When the CPU 90 judges that the spool 71 has approached a position within the predetermined distance from the cap cover 36 or 37, the CPU 90 processes a signal which comes in through a signal transmission path 91 and is to be input to the pulse motor 40 so that the spool 71 approaches a position within the predetermined distance, viz., a position of the spool 71 in the axial line direction, is put within a predetermined range, and outputs the processing result to the pulse motor 40.

Finally, the pulse motor 40, which has received the processed signal through a signal transmission path 92 from the CPU 90, rotates the rotary shaft 41 in accordance with the signal coming in through the signal transmission path 92 from the CPU 90.

Let us consider the following case: The signal to be input to the pulse motor 40 is input through the signal transmission path 91 to the CPU 90 from outside, and the CPU 90 outputs the signal, which comes from outside through the signal transmission path 91 and is to be input to the pulse motor 40, to the pulse motor 40 through the signal transmission path 92. As a result, a great difference of the number of revolutions is produced between the rotary shaft 41 and the output shaft 61. The spool 71 greatly moves in the axial line direction while linking with a motion of the first helical gear 52, and approaches a position within a predetermined distance from the cap cover 36 or the cap cover 37.

In this case, the CPU 90 first judges that the spool 71 has reached a position within the predetermined distance from the cap cover 36 or cap cover 37, by use of a spool signal output through the signal transmission path 93 from the displacement sensor 80.

Then, the CPU 90 processes a signal to be input to the pulse motor 40 from outside via the signal transmission path 91 so that the spool 71 does not reach a position within the predetermined distance from the cap cover 36 or cap cover 37, and the rotary shaft 41 rotates at the number of revolutions closest to that at which the rotary shaft rotates in accordance with the signal input to the pulse motor 40 from outside via the signal transmission path 91, and outputs the processed signal to the pulse motor 40 by way of the signal transmission path 92.

Let us consider the following case: The output shaft 61 receives a large load from an external machine. A great difference of the number of revolutions is produced between the rotary shaft 41 and the output shaft 61. The spool 71 greatly moves in the axial line direction while linking with a motion of the first helical gear 52, and reaches a position within the predetermined distance from the cap cover 36 or the cap cover 37.

In this case, the CPU 90 first judges that the spool 71 has reached a position within the predetermined distance measured from the cap cover 36 or cap cover 37, by use of the spool signal output from the displacement sensor 80 via the signal transmission path 93.

Then, the CPU 90 processes a signal to be input to the pulse motor 40 from outside via the signal transmission path 91 so that the spool 71 does not reach a position within the predetermined distance from the cap cover 36 or cap cover 37, and the rotary shaft 41 rotates at the number of revolutions closest to that at which the rotary shaft rotates in accordance with the signal input to the pulse motor 40 from outside via the signal transmission path 91, and outputs the processed signal to the pulse motor 40 by way of the signal transmission path 92.

While the embodiment is arranged so as to prevent the spool 71 from colliding with the cap cover 36 or cap cover 37, the cap cover 36 or cap cover 37 may be substituted by any member if it will collide with the spool 71.

The displacement sensor 80 is not limited to the those sensors employed in the embodiments, but may be any other sensor if it is capable of a spool position as viewed in the axial line direction of the spool valve 70.

<4th Embodiment>

Figure 11:
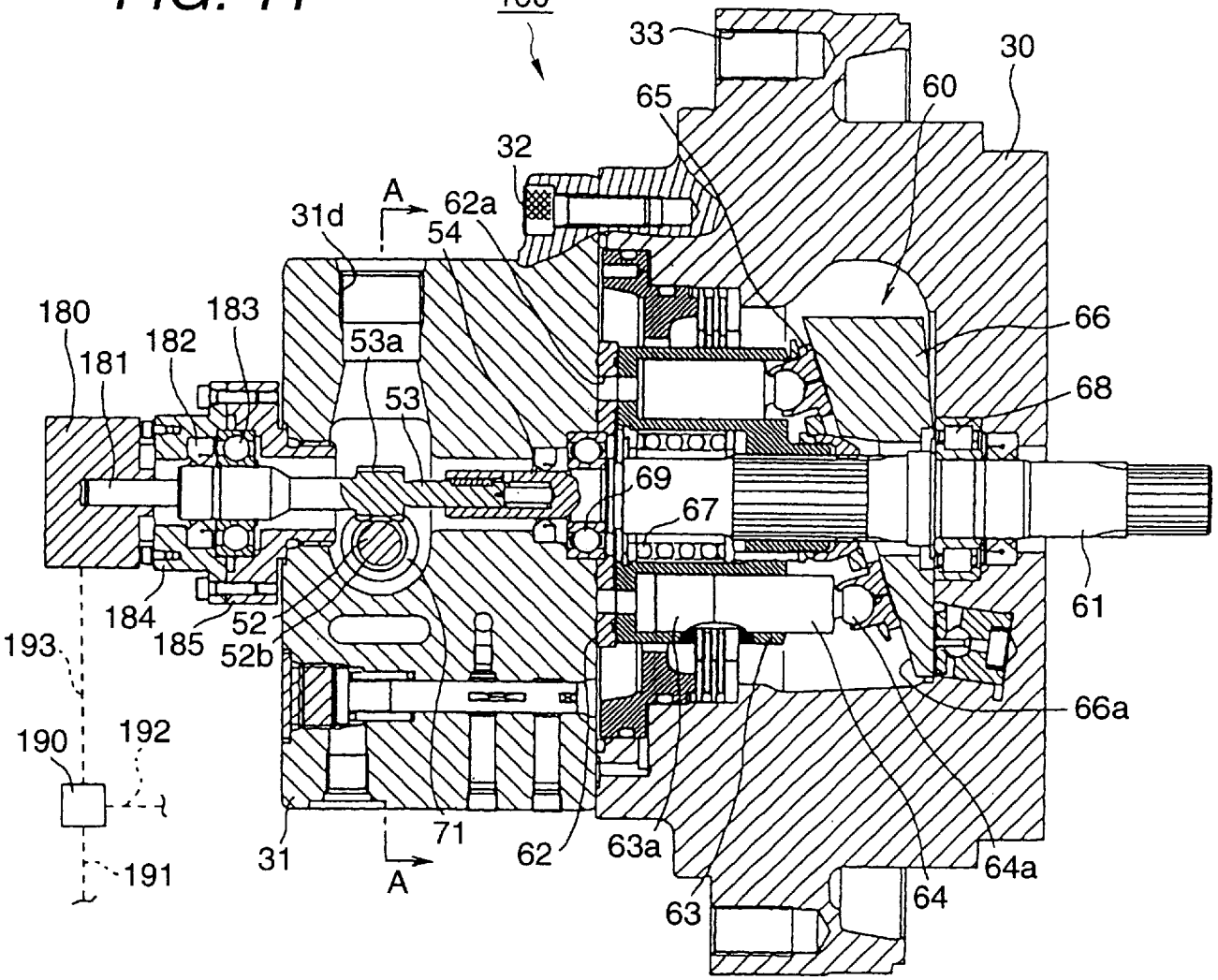
FIG. 11 is a sectional side view showing an electro-hydraulic servomotor according to a fourth embodiment of the present invention.
Figure 12:
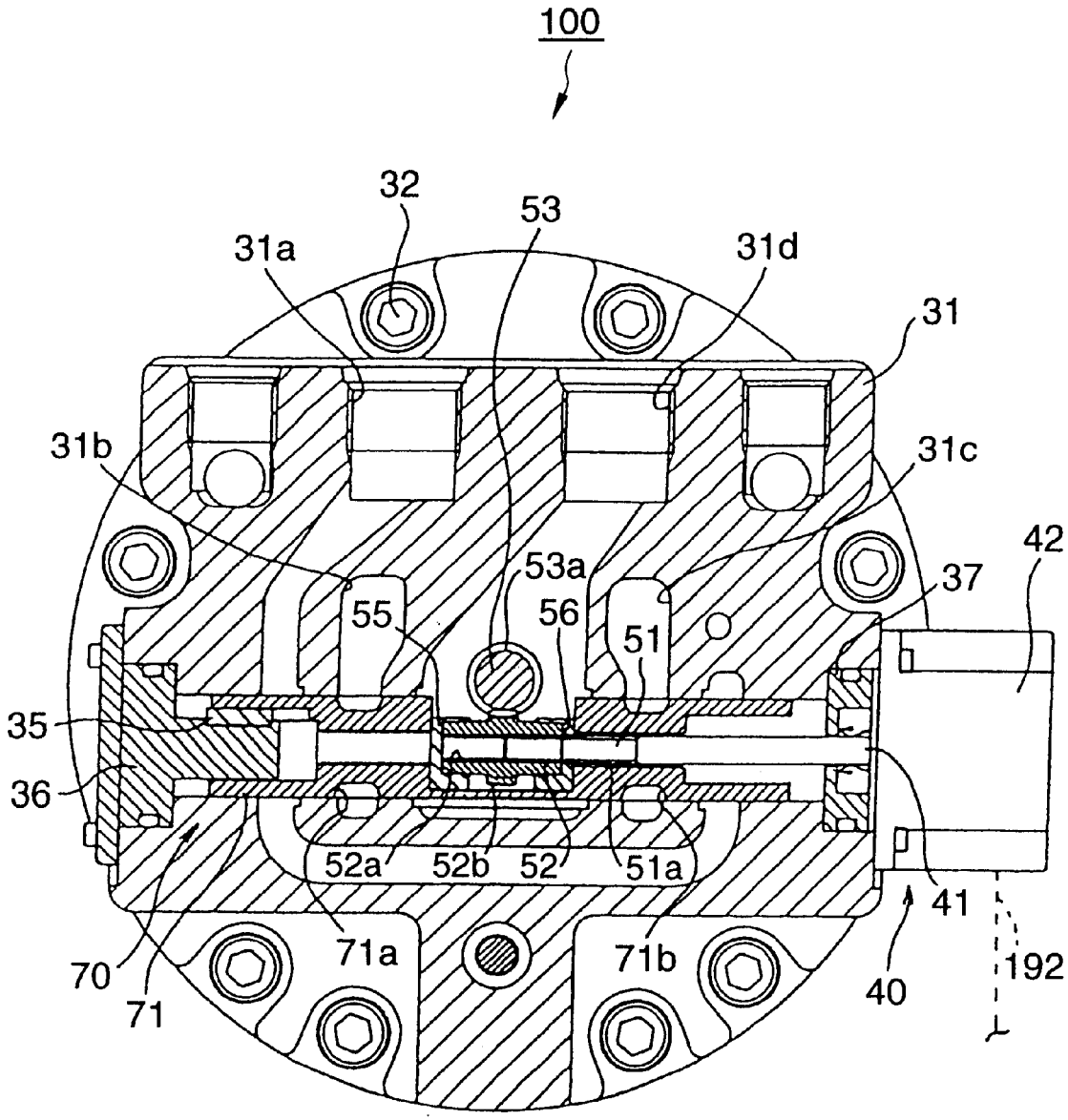
FIG. 12 is a sectional view taken along a line A—A of FIG. 11.
Figure 13:
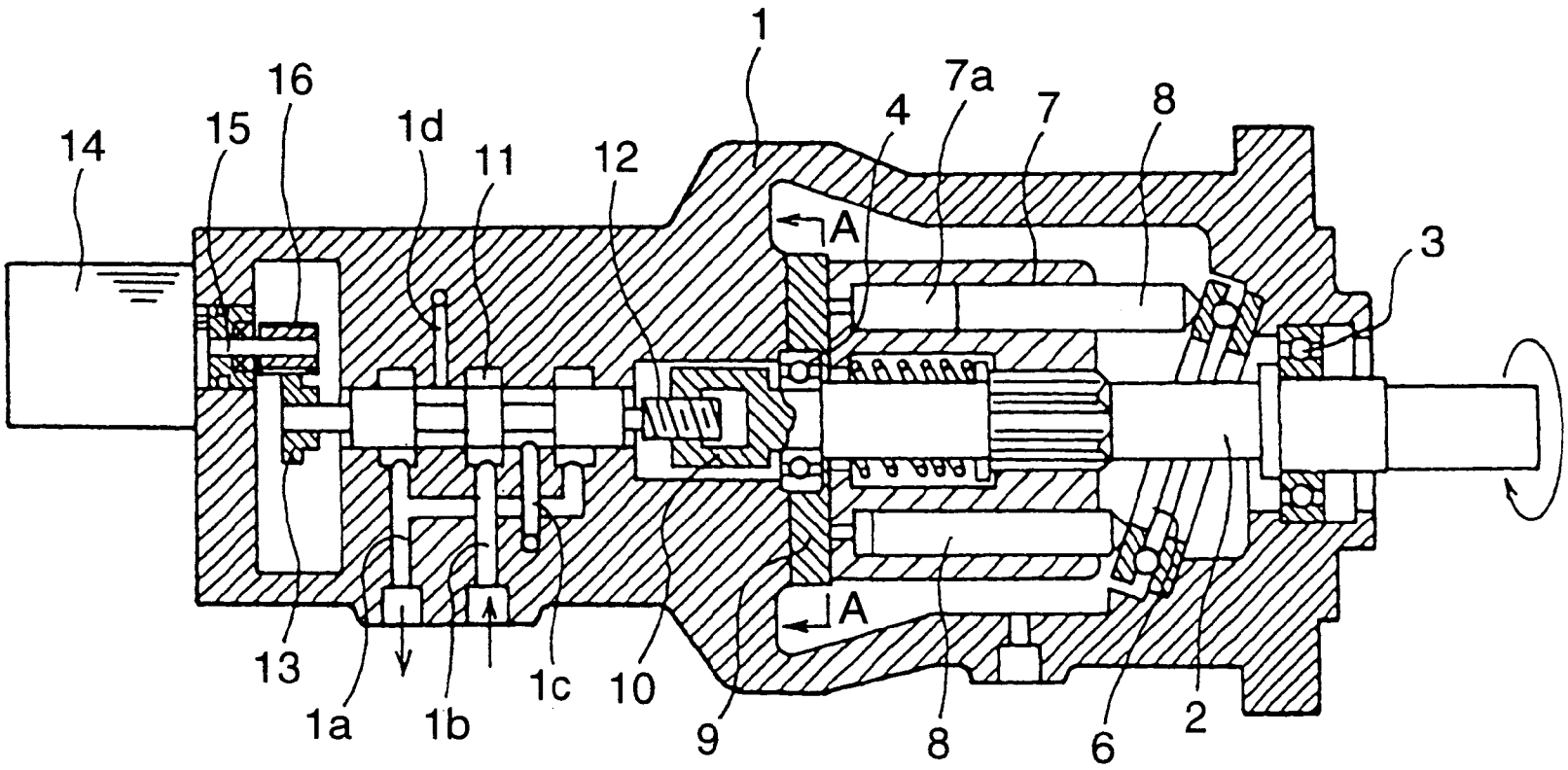
FIG. 13 is a sectional side view showing a related. electro-hydraulic servomotor.
Figure 14:
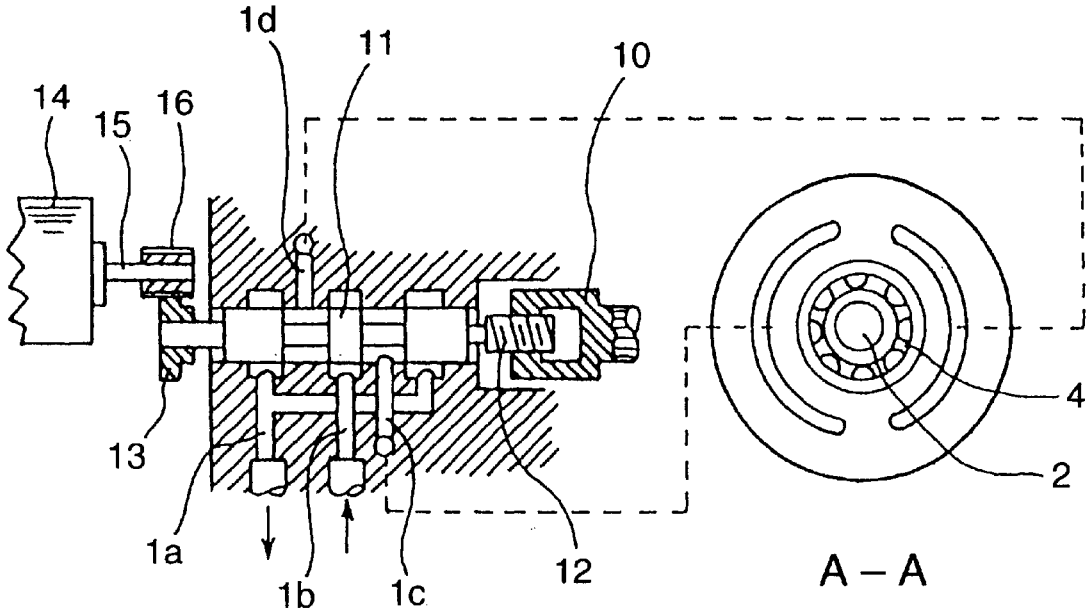
FIG. 14 is a sectional view taken along a line A—A of FIG. 13.

One of the features of a fourth Embodiment shown in FIGS. 11 and 12 resides in that a number-of-revolutions detector 180 is added to the mechanical arrangement of the first embodiment.

A detected shaft 181 as a fourth shaft is coupled at one end at the other and of the second helical gear 53. The detected shaft 181 is accommodated in the a detector first housing 184 and a second housing a detector second housing 185, which are mounted on the second casing 31, and is rotatably supported on the detector second housing 185 by means of a bearing 183. The number-of-revolutions detector 180 as a number-of-revolutions detecting means is installed in the detector first housing 184. The number-of-revolutions detector 180 detects the number of revolutions of the detected shaft 181 at the other end of the detected shaft 181, and outputs a number-of-revolutions signal in accordance with the number of revolutions of the detected shaft. A seal 182 is disposed in a space defined by the detector first housing 184 an the detected shaft 181. The seal blocks a flow of the operation oil from the second casing 31 into the number-of-revolutions detector 180.

Reference numeral 190 designates a central processing unit (CPU) as signal processing means. The CPU 190 receives a signal to be input to the pulse motor 40 and the number-of-revolutions signal. The CPU 190 processes the input signal by use of the number of revolutions of the rotary shaft 41 and the number-of-revolutions signal so that a position of the spool 71 as viewed in the spool 71 is located within a predetermined range, and outputs the processed one to the pulse motor 40. In the figures, 191, 192 and 193 designate signal transmission paths, respectively.

Description will be given about the operation of the electro-hydraulic servomotor 100 to prevent the spool 71 from colliding with the cap cover 36 or 37.

When the spool 71 greatly moves in the axial line direction while linking with a motion of the first helical gear 52, and approaches a position within a predetermined distance measured from the cap cover 36 or 37, the number of revolutions of the drive shaft 51 or the second helical gear 53 varies since a position of the first helical gear 52 in the axial line direction is determined by the number of revolutions of the drive shaft 51 and the second helical gear 5.

Since the number of revolutions of the drive shaft 51, i.e., the number of revolutions of the rotary shaft 41 is determined by the signal output from the CPU 190, the CPU 190 always provides the number of revolutions of the drive shaft 51. Since the number of revolutions of the second helical gear 53, i.e., the number of revolutions of the detected shaft 181, is applied, in the form of a number-of-revolutions signal, to the CPU 190 from the number-of-revolutions detector 180 by way of the signal transmission path 193, the CPU 190 always obtains the number of revolutions of the second helical gear 53 from the number-of-revolutions signal output from the number-of-revolutions detector 180.

When the number of revolutions of the drive shaft 51 or the second helical gear 53 varies, the CPU 190 judges that the spool 71 has reached a position within a predetermined distance from the cap cover 36 or the cap cover 37.

When the CPU 190 judges that the spool 71 has reached a position within a predetermined distance from the cap cover 36 or the cap cover 37, the CPU 190 processes a signal to be input to the pulse motor 40, which comes in through the signal transmission path 191, by use of the number-of-revolutions signal and the number of revolutions the rotary shaft 41 so that the spool 71 does no reach a position within a predetermined distance from the cap cover 36 or the cap cover 37, viz., a position of the spool 71 as viewed in the axial line direction is within a predetermined range. Then, the CPU 190 outputs the processed one to the pulse motor 40 by way of the a192.

When the CPU 190 outputs the signal to the pulse motor 40 via the signal transmission path 192, the pulse motor 40, the pulse motor 40 rotates the rotary shaft 41 in accordance with the output signal of the CPU 190, thereby locating a position of the spool 71 within the predetermined range.

In this way, the electro-hydraulic servomotor 100 prevents the spool 71 from colliding with the cap cover 36 or the cap cover 37.

Exemplar cases where the spool 71 approaches a position within the predetermined distance from the cap cover 36 or the cap cover 37 follow. In a fist case, the CPU 190 outputs a signal to the pulse motor 40 via the signal transmission path 192. As a result, a great difference of the number of revolutions is produced between the rotary shaft 41 and the output shaft 61. The spool 71 greatly moves in the axial line direction while linking with a motion of the first helical gear 52, and approaches a position within the predetermined distance from the cap cover 36 or cap cover 37. In another case, the output shaft 61 receives a load from an external machine. As a result, a great difference of the number of revolutions is produced between the rotary shaft 41 and the output shaft 61, and the spool 71 greatly moves in the axial line direction while linking with the first helical gear 52 and approaches a position within the predetermined distance from the cap cover 36 or cap cover 37.

The number-of-revolutions detector 180 is not limited to the illustrated one, but may be any detector if it is capable of the number of revolutions of the detected shaft 181.

What is claimed is:

1. An electro-hydraulic servomotor comprising:

an electric motor which rotates a drive shaft in response to an inputted signal;

a hydraulic motor which rotates an output shaft using hydraulic pressure of operation oil;

a first geared shaft rotatable along with the output shaft;

a second geared shaft threadingly engaged with the drive shaft and meshed with the first geared shaft, the first geared shaft being positioned perpendicular to the second geared shaft; and a spool axially movable along with the second geared shaft depending on a rotational difference between the drive shaft and the first geared shaft, to control supply and discharge of the operation oil to and from the hydraulic motor.

2. The electro-hydraulic servomotor according to claim 1, wherein the spool is a single integral member.

3. The electro-hydraulic servomotor according to claim 1, further comprising:

a displacement sensor (80) which detects an axial position of the spool (71).

4. The electro-hydraulic servomotor according to claim 1, further comprising:

a rotary sensor (180) which detects number of rotation of the first geared shaft (53).

5. An electro-hydraulic servomotor comprising:

an electric motor which rotates a drive shaft in response to an inputted signal;

a hydraulic motor which rotates an output shaft using hydraulic pressure of operation oil;

a first geared shaft rotatable along with the output shaft;

a second geared shaft threadingly engaged with the drive shaft and meshed with the first geared shaft; and a spool axially movable along with the second geared shaft depending on a rotational difference between the drive shaft and the first geared shaft, to control supply and discharge of the operation oil to and from the hydraulic motor, the spool being divided into first and second discrete spool members.

6. The electro-hydraulic servomotor according to claim 5, wherein the first and second spool members are urged toward one another.

7. An electro-hydraulic servomotor comprising:

an electric motor which rotates a drive shaft in response to an inputted signal;

a hydraulic motor which rotates an output shaft using hydraulic pressure of operation oil;

a first geared shaft rotatable along with the output shaft;

a second geared shaft threadingly engaged with the drive shaft and meshed with the first geared shaft, the second geared shaft having an axis; and a spool axially movable along with the second geared shaft depending on a rotational difference between the drive shaft and the first geared shaft, to control supply and discharge of the operation oil to and from the hydraulic motor, the spool has an axially elongated groove, and the second geared shaft is held within the elongated groove so that the axis of the second geared shaft is parallel to an axis of the spool.

8. The electro-hydraulic servomotor according to claim 7, further comprising:

a pair of bearings (55,56) which couple the second geared shaft (52) with the spool (71) to axially move the spool

(71) along with the second geared shaft (52), but permit relative rotation between the second geared shaft (52) and the spool (71).

9. The electro-hydraulic servomotor according to claim 8, further comprising:

means for preventing rotation of the spool (71).

10. The electro-hydraulic servomotor according to claim 7, further comprising:

means for preventing rotation of the spool (71).

11. The electro-hydraulic servomotor according to claim 7, wherein the elongated groove is located at an intermediate portion of the spool.

12. An electro-hydraulic servomotor comprising:

an electric motor which rotates a drive shaft in response to an inputted signal;

a hydraulic motor which rotates an output shaft using hydraulic pressure of operation oil;

a first geared shaft rotatable along with the output shaft, the drive shaft being non-parallel to the first geared shaft;

a second geared shaft threadingly engaged with the drive shaft and meshed with the first geared shaft; and a spool axially movable along with the second geared shaft depending on a rotational difference between the drive shaft and the first geared shaft, to control supply and discharge of the operation oil to and from the hydraulic motor.

13. An electro-hydraulic servomotor comprising:

an electric motor which rotates a drive shaft in response to an inputted signal;

a hydraulic motor which rotates an output shaft using hydraulic pressure of operation oil;

a first geared shaft rotatable along with the output shaft, the drive shaft being perpendicular to the first geared shaft;

a second geared shaft threadingly engaged with the drive shaft and meshed with the first geared shaft; and a spool axially movable along with the second geared shaft depending on a rotational difference between the drive shaft and the first geared shaft, to control supply and discharge of the operation oil to and from the hydraulic motor.

14. An electro-hydraulic servomotor comprising:

an electric motor which rotates a drive shaft in response to an inputted signal;

a hydraulic motor which rotates an output shaft using hydraulic pressure of operation oil;

a first geared shaft rotatable along with the output shaft;

a second geared shaft threadingly engaged with the drive shaft and meshed with the first geared shaft;

a spool axially movable along with the second geared shaft depending on a rotational difference between the drive shaft and the first geared shaft, to control supply and discharge of the operation oil to and from the hydraulic motor;

a spool position detecting means for detecting an axial position of the spool, and outputting a spool position signal indicative of the detected axial position; and an input signal processing means for receiving a signal to be inputted to the electric motor and the spool position signal, correcting the signal to be inputted to the electric motor based on the spool position signal, and outputting the thus corrected signal to the electric motor to control the axial position of the spool to fall within a predetermined range.

15. The electro-hydraulic servomotor according to claim 14, wherein the electric motor is disposed on one end side of the spool and the spool position detecting means is disposed on the other end side of the spool.

16. An electro-hydraulic servomotor comprising:

an electric motor which rotates a drive shaft in response to an inputted signal;

a hydraulic motor which rotates on output shaft using hydraulic pressure of operation oil;

a first geared shaft rotatable along with the output shaft;

a second geared shaft threadingly engaged with the drive shaft and meshed with the first geared shaft;

a spool axially movable along with the second geared shaft depending on a rotational difference between the drive shaft and the first geared shaft, to control supply and discharge of the operation oil to and from the hydraulic motor;

a rotational number detecting means for detecting a number of rotations of the first geared shaft and outputting a rotational number signal indicative of the thus detected number of rotations; and an input signal processing means for receiving a signal to be inputted to the electric motor and the rotational number signal, correcting the signal to be inputted to the electric motor based on the rotational number signal, and outputting the thus corrected signal to the electric motor to control the axial position of the spool to fall within a predetermined range.

* * * * *